United States Patent [19]

Jackson

[11] Patent Number: 4,655,250

[45] Date of Patent: Apr. 7, 1987

[54] OPEN CENTER UNLOADING VALVE

[75] Inventor: Alan C. Jackson, Halstead, Kans.

[73] Assignee: The Cessna Aircraft Company, Wichita, Kans.

[21] Appl. No.: 825,622

[22] Filed: Feb. 3, 1986

[51] Int. Cl.[4] ..... F15B 13/08

[52] U.S. Cl. ..... 137/596.13; 137/101; 137/596.12

[58] Field of Search ..... 137/101, 596.12, 596.13

[56] References Cited

U.S. PATENT DOCUMENTS 3,411,295 11/1968 Byers ..... 60/427

3,815,477 6/1974 Ailshie et al. ..... 137/596.13 X 4,121,601 10/1978 Presley ..... 137/101

*Primary Examiner*—Gerald A. Michalsky

*Attorney, Agent, or Firm*—Edward L. Brown, Jr.

[57] ABSTRACT

An unloading valve utilized in an open center hydraulic system in conjunction with a conventional open center control valve having an open center passage and a dead end power passage; the unloading valve is supplied by a system pressure from a pump and divides the pump flow into two paths in a set proportion regardless of the amount of flow or pressure levels in either flow path, one flow path is directed to reservoir with the other flow path directed to the open center passage in the directional control valve while the dead end power passage of the control valve is separately provided with system pump pressure in a parallel path whereby only a portion of the pump discharge passes across the open center passage when the directional control valve is neutrally positioned.

7 Claims, 3 Drawing Figures

OPEN CENTER UNLOADING VALVE

BACKGROUND OF THE INVENTION

In the field of mobile hydraulics several different types of systems have evolved over the years which can be classified as either open center or closed center systems. An open center system has a fixed displacement pump and circulates the entire pump flow through the control valves when not in use. A closed center system is supplied by a variable displacement pump that delivers only the flow required to operate a motor at a desired speed, while in neutral or when not in use the pump discharge is at a zero flow level and a low standby pressure. Closed center systems, also referred to as load-sensing, are more efficient than the traditional open center system, however, they are much higher in initial cost and complexity due to the use of variable displacement pumps, more complex valves and added sensing lines thoughout the system.

An open center type of system includes an inexpensive fixed displacement pump which supplies a constant flow rate to one or more directional control valves in a bank which in turn control individual motors. The pressure maintained in open center systems is that which is necessary to overcome the pressure losses in the system and operate the motors. Since the pump in a conventional open center system always operates at its maximum flow level, there is a waste of energy in its neutral or non-use position since that maximum pump discharge must flow across all of the open center passages in each of the valves in the system before returning to reservoir. In this neutral standby condition, where none of the motors are being operated, the entire output flow from the pump passes through each of the open center passages of each valve to reservoir and the power utilized in moving this high volume of oil is completely dissipated in heat. In systems with four or five functions, this energy loss becomes substantial since this high volume of oil must pass across each valve in the system.

One hybrid system for minimizing such an energy loss is the use of closed center directional control valves which have an unloading valve in the inlet section or first section. When neutrally positioned, the unloading valve dumps the entire pump flow to reservoir without havng to circulate the pump flow through each valve in the system, as for example shown in U.S. Pat. No. 3,411,295. A similar hybrid system is illustrated in U.S. Pat. No. 3,815,477 which utilizes a similar unloading valve with a series of closed center valves in a modern load sensing system.

SUMMARY OF THE INVENTION

The system of the present invention incorporates a conventional proportional flow-dividing valve and utilizes such a valve as an unloading valve in conjunction with one or more conventional open center valves. Most unloading valves in the prior art, such as the two mentioned in the patents above, are used in closed center systems where they dump all of the pump flow across an unloading valve so that all of the pump capacity does not have to flow across each spool section of the system, as in a conventional open center system.

A flow-dividing valve basically separates a path of oil in a set volumetric proportion, either 50–50 or whatever is desired, into two flow paths regardless of the volume of flow or the pressure level in either flow path. This function is achieved through the use of two fixed orifices each being in one of the split paths which sense the pressure drop thereacross, and accordingly signal variable orifices downstream from each of the fixed orifices to restrict whichever flow is becoming excessive so as to maintain a set proportion therebetween. A typical flow-divider valve and its function is shown in U.S. Pat. No. 4,121,601.

In the system of the present invention, the unloading valve which is a flow-divider valve, is placed between the pump source and the directional control valve in a parallel path with the power passage of the directional control valve. One of the split paths from the unloading valve is connected with the open center passage in the control valve while the other split path is connected to reservoir. With the directional control valve in neutral, the unloading valve splits the pump flow sending, for example, thirty percent (30%) of the flow through the open center passages of the control valve while the remaining seventy percent (70%) returns directly to tank. Bypassing a substantial portion of the pump flow to reservoir not only decreases the energy loss from flow through the open center passages, but also increases the flow capacity which the directional control valve can handle.

It is therefore the principal object of the present invention to provide a simplified unloading valve in a conventional open center system which utilizes a conventional flow-divider valve.

Another object of the present invention is to provide an unloading valve which can be added to a conventional open center hydraulic system for reduced spool effort.

A further object of the present invention is to provide an unloading valve in a conventional open center system to increase the capacity of the hydraulic system while diminishing the spool effort in metering conditions.

These and other important objects and advantages of the present invention as specifically set forth in or will become apparent from the following detailed description of preferred embodiments of the invention, when read in conjunction with the accompanying drawing, wherein.

DETAILED DESCRIPTION OF THE INVENTION

Figure 1:
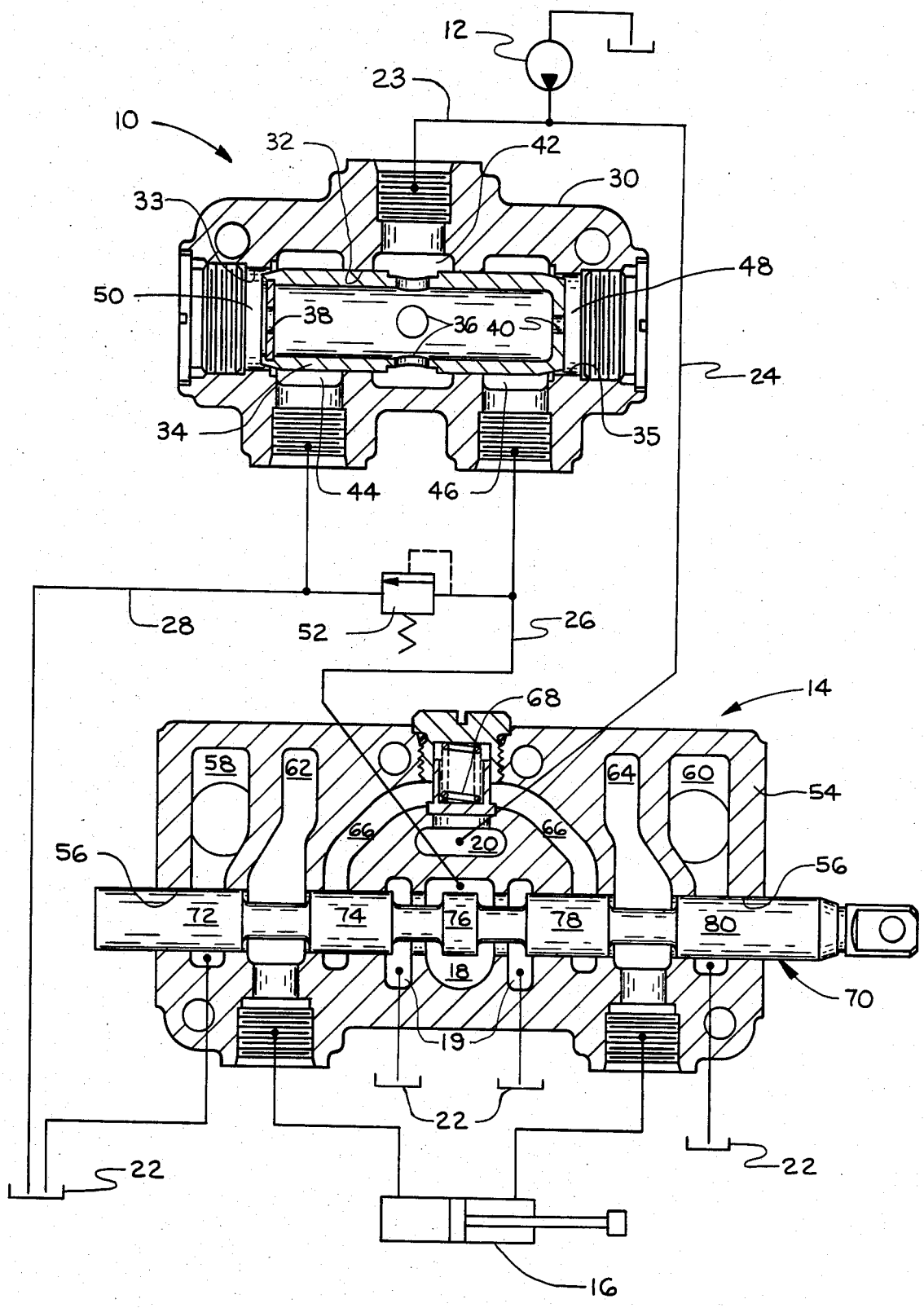
FIG. 1 is a partially schematic representation of a hydraulic system constructed in accordance with the princples of the present invention with the directional control valve neutrally positioned, and the unloading valve shown in longitudinal cross section.

FIG. 1 illustrates an open center hydraulic circuit wherien a fixed displacement pump supplies a motor 16 through a conventional directional control valve 14 and an unloading valve 10. While the drawing illustrates only a single directional control valve 14, the valve is a stack type valve, which allows multiples of the valve to be used together, one stacked upon the other, as illustrated in FIG. 4 of U.S. Pat. No. 3,815,477 mentioned above. Pump 12 is an inexpensive fixed displacement gear pump which supplies unloading valve 10 and directional control valve 14 in a parallel path via conduits 23 and 24. Conduit 24 connects the pump discharge to a dead end power passage 20 which passes through each directional control valve 14 in the stack. In a parallel path 23, pump 12 also supplies the inlet passage 42 of the unloading valve 10. Unloading valve 10 splits the inlet flow from passage 42 into two outlet passages 44 and 46 in a set proportion based on the size of orifices 38 and 40. Orifices 38 and 40 do not have to be in the spool 34, they could be located in the valve body 30 in a separate passage connecting passage 42 and servo chambers 48 and 50.

Unloading valve 10 comprises a body 30 which has a longitudinal bore 32 therethrough which intercepts outlet passages 44 and 46 and inlet passage 42. Slidably positioned in bore 32 is a shuttle spool 34 with each end being tapered on the O.D. so that the end of the spool forms a variable orifice with either portion 33 or 35 of the bore. Spool 34 is hollow with lateral openings 36 located in the center of the spool for receiving flow from the pump to enter the center of the spool and depart from opposite ends of the spool in a split path through orifices 38 and 40 respectively.

The positioning of spool 34 is effected by the pressure drops across orifices 38 and 40, since the pressures in servo chambers 50 and 48 are both acting against the opposite end areas of the spool, urging the spool to the right or to the left respectively. Oil flows out the end of spool 34 through orifice 38 into servo chamber 50 and then reverses direction backwards into outlet passage 44 through the annular opening made by the bore 33 and the tapered end of the spool. This annular opening is in effect a variable orifice positioned downstream from the fixed orifice 38 and controls the flow rate through the fixed orifice 38. The tapered right end of the spool 34 adjacent orifice 40 also acts in conjunction with portion 35 of the bore to act as a variable orifice positioned just downstream of fixed orifice 40. If there is no flow through either orifice 38 or 40, there will be no pressure drop on the downstream side in chambers 50 and 48 respectively. Therefore, there will be no net force urging the spool 34 in one direction or the other.

When there is flow through the orifices 38 and 40, there can be a force imbalance on the spool causing the spool to shift one way or the other. For example, if the flow out the left end of the spool through orifices 38 becomes excessive, there will be a greater pressure drop felt on the left end of the spool than the right end, thus causing the spool to shift in a leftward direction. The variable orifice formed by the left end of the spool in portion 33 of the bore therefore becomes smaller and reduces the flow rate through fixed orifice 38, thus reducing the pressure in servo chamber 50. The spool 34 will continue to move to the left until the flow rates across both orifices 38 and 40 create identical pressure drops at which time the spool will cease movement. If orifices 38 and 40 were identical in area, spool 34 would always split the flow in outlet passages 44 and 46 in a 50-50 proportion.

Left outlet passage 44 is connected to reservoir 22 via line 28 while right outlet passage 46 is connected to open center passage 18 in the directional control valve 14.

Directional control valve 14 comprises a valve body 54 having a longitudinal bore 46 therethrough. Intercepting bore 56 from left to right is drain passage 58, motor port passage 62, u-shaped power passage 66, drain passage 19, open center passage 18, drain passage 19, u-shaped power passage 66, motor port passage 64 and drain passage 60. Slidably positioned in bore 56 is a valve spool 70 having lands 72, 74, 76, 78 and 80 respectively. Valve spool 70 is illustrated in the neutral position with left and right motor ports 62 and 64 respectively, shown blocked off from both pump pressure and drain by spool lands 72 and 74 in the case of left motor port, and lands 78 and 80 in the right motor port 64. Open center passage 18 is open in the neutral position so that pump pressure entering through conduit 26 passes to drain through adjacent drain passages 19. When there are more than two valve sections in the stack, drain passages 19 actually connect into a similar open center passage 18 in the next adjacent valve section.

A second pump pressure conduit 24 is connected to directional control valve 14 as symbolically shown by line 24 into dead end power passage 20 which is a parallel passage to the open center flow through conduit 26. Power passage 20 opens into all the sections in the valve stack and is transmitted to each of the valve spool bores through individually u-shaped power passages 66 across a single load check 68. With a u-shaped power passage 66 in each valve section, pump pressure is provided adjacent both motor port passages 62 and 64 on the right and left sides respectively with drain passages 58 and 60 on the opposite sides of motor port passages 62 and 64. Directional control valve 14 and all of its particular passages just described is a conventional design open center valve well known in the art.

Directional control valve 14 through its left and right motor ports 62 and 64 controls motor 16 which is symbolically shown as a double-acting cylinder, however, various other types of reversible motors or single acting cylinders could be substituted in place of cylinder 16. Master relief valve 52 is positioned downstream of unloading valve 10 and conduit 26, and immediately upstream of the first valve section 14. The relief valve could likewise be located in parallel conduit 24.

Figure 2:
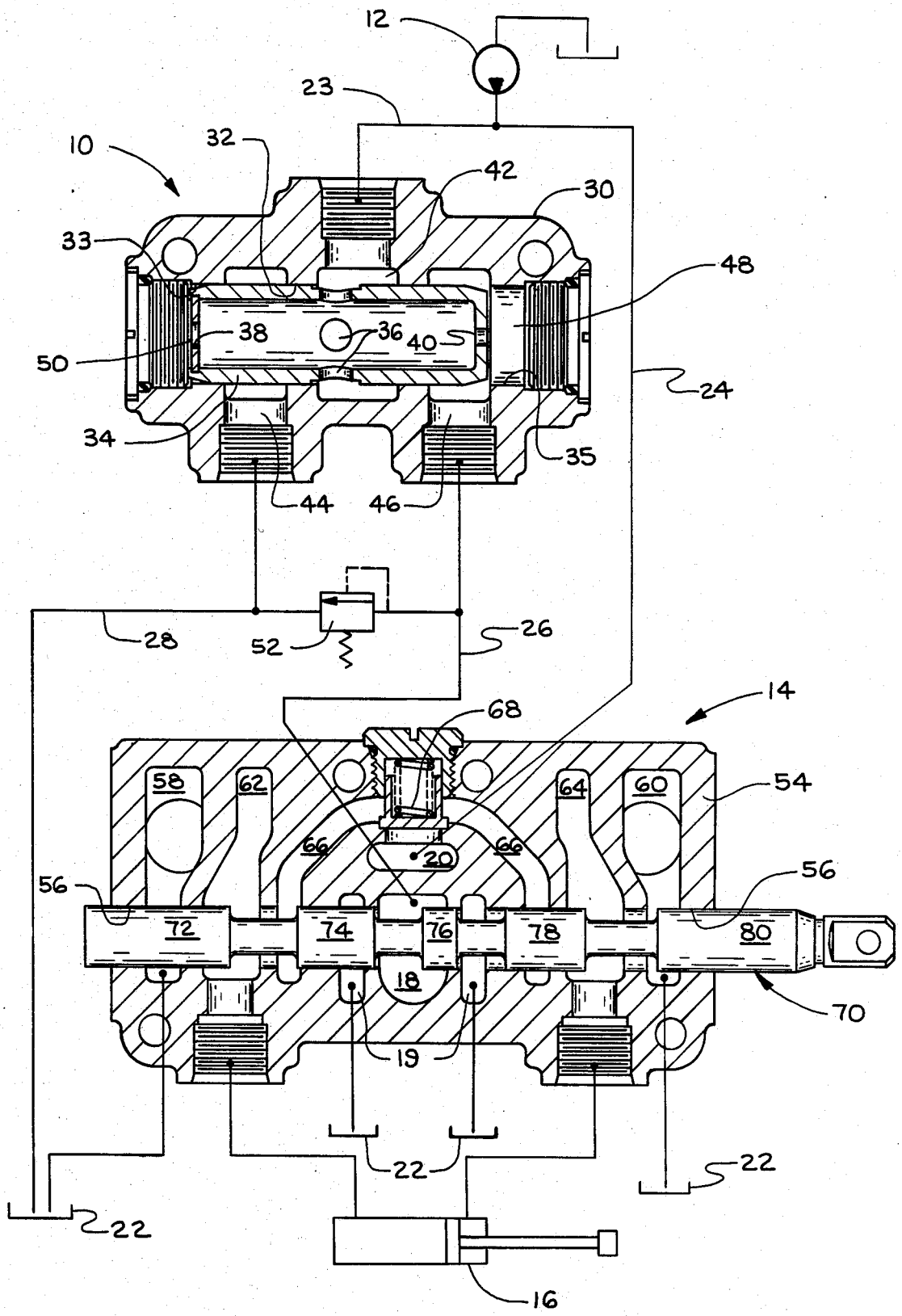
FIG. 2 is a similar schematic view with the directional control valve powering the left motor port and the unloading valve blocking all flow therethrough.
Figure 3:
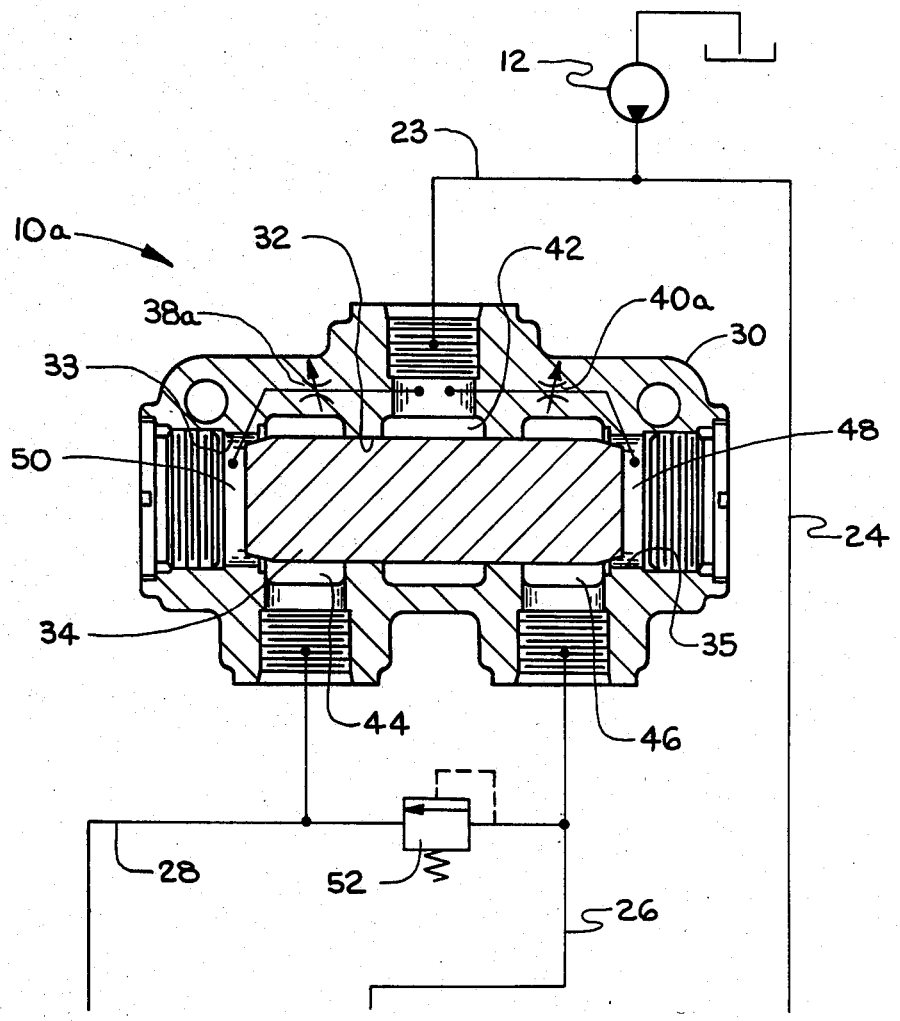
FIG. 3 is a modified form of the unloading valve with the directional control valve omitted.

FIG. 3 illustrates a modified embodiment of the unloading valve wherein the fixed orifices 38*a* and 40*a* are adjustable so that the flow rate porportions in the two flow paths can be changed. Unloading valve 10*a* is connected in an identical manner to the directional control valve 14, as shown in FIGS. 1 and 2.

OPERATION

Directional control valve 14 has three basic positions; a neutral position as illustrated in FIG. 1; a power position retracting cylinder 16 by shifting spool 70 leftward; and a reverse power position as illustrated in FIG. 2, shifting the spool 70 rightwardly allowing pump pressure into motor port 62 for movement of motor 16 in the reverse direction.

In the neutral or standby position of FIG. 1, there is no flow to the motor 16 and all of the pump discharge from pump 12 passes through unloading valve 10 in a split flow path. The pump flow entering inlet passage 42 into the center of shuttle spool 34 via openings 36, is divided into two flow paths, one exiting outlet passage 44 via orifice 38 while the other exits outlet passage 46 via orifice 40. The flow in passage 44 passes directly to reservoir 22 through conduit 28 while the flow from outlet passage 46 passes through the open center passage 18 of the directional control valves through conduit 26. The flow from open center passage 18 flows across the spool grooves into drain passages 19 or in the case of multiple directional control valves into the open center passage 18 of the adjacent valve section. By reason of the larger sizing of the orifice 38 over orifice 40, a higher portion of the flow from pump 12 will pass directly to reservoir 22 since it will take a higher flow rate through orifice 38 to create the same pressure drop which is created from flow across orifice 40. In the neutral position, shuttle spool 34 will automatically position itself so that the divided flow paths in passages 44 and 46 are always in the same proportion with, for example, seventy percent (70%) of the flow exiting outlet passage 44 while thirty percent (30%) of the pump discharge exits outlet passage 46. This is true whether the flow from the pump is 2 GPM or 50 GPM.

When the operator desires to actuate motor 16 in an extended direction, valve spool 70 is shifted in a rightward direction and spool lands 74 and 76 begin to close off the open center flow through passage 18. This causes back pressure to build in conduit 26 which in turn slows the flow through orifice 40 causing a pressure increase in servo chamber 48. This pressure or force imnbalance causes spool 34 to automatically shift in a leftward direction causing the left end of spool 34 to decrease the annular orifice in bore 33 until the preset proportion flow rate aross the two orifices is again achieved.

With spool 70 beginning to restrict the open center flow and shuttle spool 34 restricting the flow across bore portion 33, pump discharge pressure begins to build. Further movement of spool 70 to the right, as seen in FIG. 2, opens left motor port 62 to pump power passage 66, however, if the load on motor 16 is still greater than the pump discharge pressure in power passage 20, load check 68 prevents any backflow from motor 16 through u-shaped power passage 66. Sufficient restriction of the open center flow by spool lands 74 and 76 will build the pump discharge pressure sufficiently high to exceed the load on motor 16 and cause pump pressure to flow across load check 68 into the left end cylinder 16. Once open center passage 18 in the directional control valve 14 is completely blocked, as seen in FIG. 2, there will be no flow across orifice 40 and the force imbalance in servo chambers 50 and 48 will cause shuttle spool 34 to shift further to the left so as to block all flow exiting the left end of the shuttle spool via outlet passage 44. Unloading valve 10 has now completely blocked the flow in conduits 28 and 26 forcing the entire pump discharge into the parallel conduit 24, flowing to motor 16.

When there is flow across the open center passage 18, unloading valve 10 will bypass seventy percent (70%) of the flow directly to reservoir in conduit 28. This reduced flow level across open center passage 18 reduces the Bernoulli forces on spool 70 and accordingly allows for less pool effort in a metering condition of heavy load.

The pressure drop across the open center passage 18 is governed by the pressure level necessary to raise or lower the load on motor 16. When that pressure level in conduit 26 exceeds a safe level, relief valve 52 opens the pump discharge flow directly to reservoir 22 via conduit 28. When the control valve spool 70 is not completely blocking open center flow through passages 18 and 19, shuttle spool 34 will automatically adjust its position so as to always maintain a proportioned flow rate in the split flow paths. As for example, if the load on motor 16 begins to increase as it is moving, the flow rate through orifice 40 will decrease causing shuttle spool 34 to shift further to the left and further restrict flow through orifice 38 until the pressure drop induced forces in servo chambers 50 and 48 again equalize.

When it is desirous to reverse directions on motor 16, valve spool 70 is shifted from its FIG. 2 position to the left causing spool lands 76 and 78 to begin restricting the open center flow out of passage 18 to build pressure while the right edge of land 78 opens pump pressure in power passage 66 into motor port 64, while spool land 72 opens motor port 62 to drain passage 58. Unloading valve 10 functions in an identical manner as described above in either power position of directional control valve 14.

While unloading valve 10 is shown remote from directional control valve 14, it could be located in the same body or casting as with the directional control valve or an end plate of the valve. Likewise the unloading valve 10 could be located in the pump 12. The unloading valve could also be remotely located in a power beyond configuration.

Orifices 38 and 40 could be externally adjustable by a set screw if they were located in the valve body 30 as mentioned before.

The discharge of the open center passage 18 could be connected to a smaller secondary system rather than to reservoir to provide the flow requirements of a smaller secondary system.

Having described the invention with sufficient clarity that those skilled in the art may make and use it, what is claimed as new and desired to be secured by letters patent is:

1. An unloading valve utilized in an open center hydraulic circuit, the circuit including a pump supply at least one motor through at least one conventional open center control valve in a stack, each control valve having an open center neutral passage connected in series to reservoir and a dead end passage passing through each of the control valves in the stack, a first conduit means connecting the pump to the dead end power passage;

and a second conduit means parallel to the first conduit means connecting the pump to the open center neutral passages;

the unloading valve positioned in the second conduit means comprising a spool means in a bore which splits the intake flow from the pump in two paths regardless of the flow level in a set proportion directing one path to the open center neutral passage and the other path to resevoir, whereby in the neutral positions of the control valves a substantial portion of the pump flow is diverted away from the control valves to increase the flow capacity of the control valves and minimize energy loss in a neutral position.

2. An unloading valve as set forth in claim 1, wherein the divided flow to the reservior is larger than the flow to the open center passages in the control valves.

3. An unloading valve as set forth in claim 1, wherein the divided flow path to reservoir is more than double the flow in the other paths.

4. An unloading valve as set forth in claim 1, wherein the spool means of the unloading valve is a hollow shuttle spool positioned in a bore which passes the entire intake flow through a lateral opening in the spool into the center of the spool with the two ends of the spool acting as variable orifices in the two split flow paths with passages in said bore and two fixed orifices, one in each end of the spool upstream of the variable orifices sending the flow rates in the two divided paths and servo means acting on the ends of the shuttle spool responsive to the pressure drops across the fixed orifices whereby the servo means will adjust the variable orifices so that the proportionate flow rate in the two divided flow paths remains the same regardless of flow amount of pressure in either of the two divided flow paths.

5. An unloading valve as set forth in claim 1, wherein the unloading valve is loacted in close proximity with the pump.

6. An unloading valve as set forth in claim 1, wherein the spool means positioned in the bore has opposite ends which comprise two variable orifice means with passages in the bore which variable orifices maintain the set proportion in the two flow paths, the bore areas adjacent each opposite end of the spool means comprises a servo chamber for positioning the spool means and a pair of fixed flow orifices one in each flow path upstream of each variable orifice.

7. An unloading valve as set forth in claim 1, wherein the spool means positioned in the bore has opposite ends which comprise two variable orifice means with passages in the bore which variable orifices maintain the set proportion in two flow paths, the bore areas adjacent each opposite end of the spool means comprises a servo chamber for positioning the spoool means and a pair of fixed flow adjustable orifices one in each flow path upstream of each variable orifice.

* * * * *